United States Patent [19]

Yamagami

[11] Patent Number: 4,703,230

[45] Date of Patent: Oct. 27, 1987

[54] RASTER OPERATION CIRCUIT

[75] Inventor: Nobuhiko Yamagami, Tokyo, Japan

[73] Assignee: Kabushiki Kaisha Toshiba, Kawasaki, Japan

[21] Appl. No.: 900,516

[22] Filed: Aug. 26, 1986

[30] Foreign Application Priority Data

Aug. 30, 1985 [JP] Japan ..... 60-191541
Aug. 30, 1985 [JP] Japan ..... 60-191542

[51] Int. Cl.[4] ..... H01J 29/70; H01J 29/72

[52] U.S. Cl. ..... 315/364; 315/365; 315/367; 340/723

[58] Field of Search ..... 315/364, 365, 367; 340/723

[56] References Cited

U.S. PATENT DOCUMENTS 4,586,037 4/1986 Rosener et al. ..... 340/724

*Primary Examiner*—Theodore M. Blum

*Attorney, Agent, or Firm*—Finnegan, Henderson, Farabow, Garrett & Dunner

[57] ABSTRACT

In a graphic display apparatus having a digital differential analyzer (DDA), a chrominance data stored in a register is written in an area of a bit map memory defined by coordinates generated from DDA by a write control circuit in response to ARDY signal. A first flip-flop is reset by a busy signal from the write control circuit and is set by a load signal. When the first flip-flop is in a reset state, a first gate produces PRDY signal requesting a microprocessor to load the chrominance data in the register in response to RDY signal indicating completion of a coordinate setting operation from DDA. When the first flip-flop is in a set state, a second gate generates CRDY signal in response to RDY signal. CRDY and RDY signals are supplied to a selector which selects one of them due to a second flip-flop for switching a line processing mode and a raster operation mode, and supplies the selected signal to the write control circuit to thereby perform write operation.

6 Claims, 22 Drawing Figures

FIG. 2A GO
FIG. 2B Xi/Yi
FIG. 2C RDY
FIG. 2D PRDY
FIG. 2E LOAD
FIG. 2F DRDY
FIG. 2G CRDY
FIG. 2H ARDY
FIG. 2I BSY

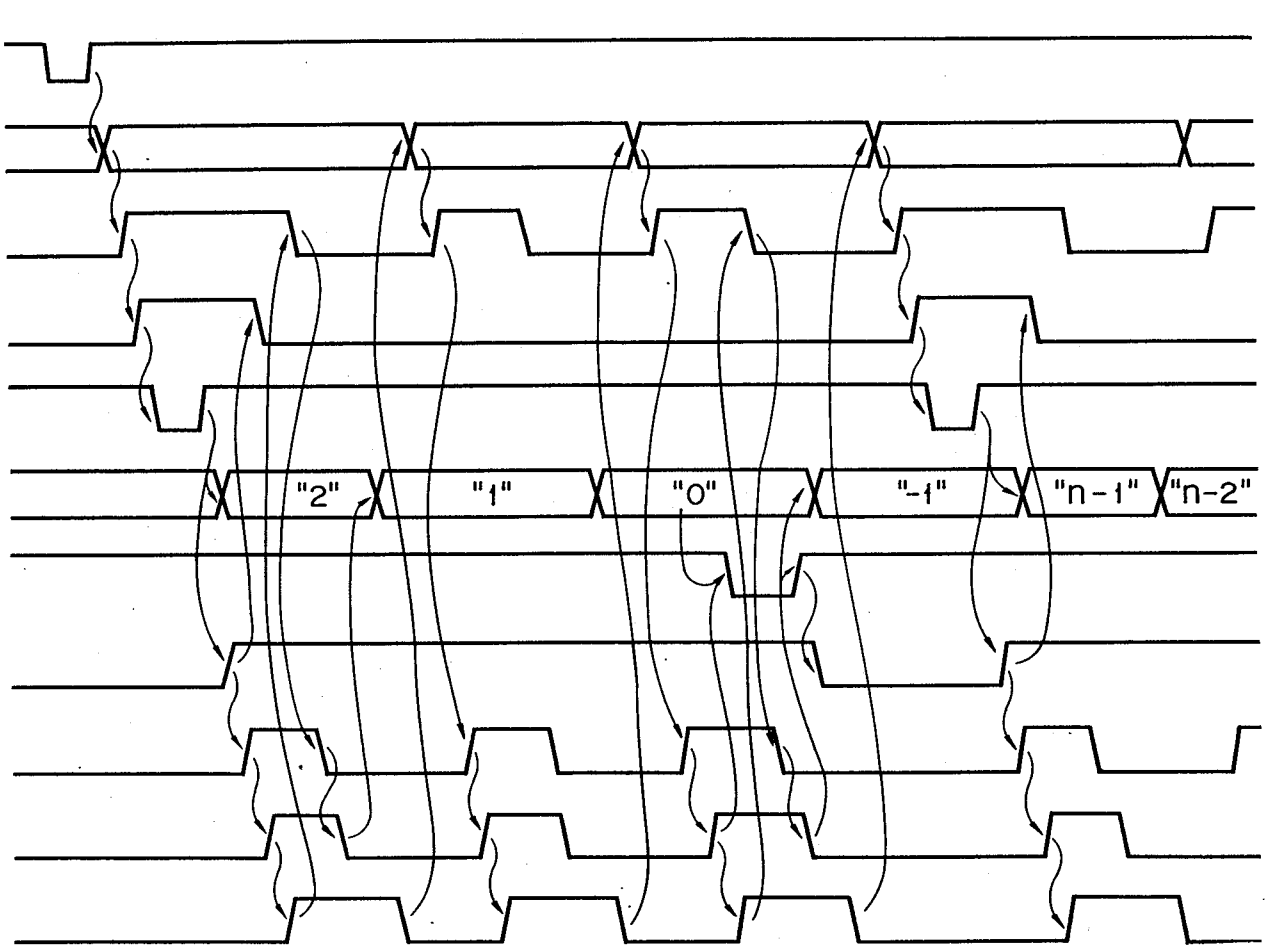
"2"
"1"
"0"
"-1"
"n-1"
"n-2"
FIG. 4A GO
FIG. 4B Xi/Yi
FIG. 4C RDY
FIG. 4D PRDY
FIG. 4E LOAD
FIG. 4F CNT
FIG. 4G BO
FIG. 4H DRDY
FIG. 4I CRDY
FIG. 4J ARDY
FIG. 4K BSY

RASTER OPERATION CIRCUIT

BACKGROUND OF THE INVENTION

The present invention relates to a raster operation circuit which displays a figure, the display color of which changes for each pixel, on a rectangular region of a screen.

A graphic display apparatus having a frame memory for storing a figure to be displayed normally processes figures as a set of lines. In recent years, such a graphic display apparatus is required to display a figure, the display color of which changes for each pixel like a photograph, i.e., to perform a raster operation. The raster operation is conventionally performed by address conversion and display color designation processing for each pixel by a microprocessor, and the like.

However, the conventional raster operation applies a heavy load to the microprocessor, and takes a great deal of processing time. In addition, the graphic display apparatus of this type is required to display a figure, in which an arbitrary number of continuous pixels are displayed in an identical color, i.e., to perform a run-length operation. The run-length operation is conventionally performed by address conversion and display color designation processing for each pixel by a microprocessor, and the like.

However, the run-length operation similarly applies a heavy load to the microprocessor, and takes a great deal of processing time.

SUMMARY OF THE INVENTION

It is an object of the present invention to provide a raster operation circuit which can significantly reduce a load on a microprocessor associated with a raster operation by adding only a small amount of hardware, and can achieve high-speed processing.

It is another object of the present invention to provide a run-length operation circuit which can significantly reduce a load on a microprocessor associated with a run-length operation by adding only a small amount of hardware, and can achieve high-speed processing.

In order to achieve the above objects, there is provided a raster operation circuit in a graphic display apparatus, which is activated by a start signal from a microprocessor and comprises a digital differential analyzer for sequentially generating coordinates of a raster array approximating a line connecting a given starting point and an end point, comprising:

a register for loading chrominance data in response to a load signal from the microprocessor;

a write control circuit for writing the content of the register in a region of a frame memory specified by coordinates generated from the digital differential analyzer in response to a first ready signal (ARDY) and generating a busy signal indicating that said write control circuit is busy;

a first flip-flop which is reset in response to a busy signal representing that the write control circuit is busy and is set in accordance with the load signal;

a first gate for producing a third ready signal (PRDY) requesting to the microprocessor a chrominance data load operation with respect to the register in response to a second ready signal (RDY) indicating completion of a coordinate setting operation from the digital differential analyzer when the first flip-flop is in a reset state;

a second gate for generating a fourth ready signal (CRDY) in response to the second ready signal when the first flip-flop is in a set state;

a second flip-flop for setting one of a line processing mode and a raster operation mode in response to a mode signal from said microprocessor; and a selector for selecting one of the second and fourth ready signals in accordance with the logic state of the second flip-flop and supplying the selected ready signal as the first ready signal to the write control circuit.

According to the present invention, address conversion in the raster operation can be performed by using an approximate raster array coordinate generation function of a digital differential analyzer (DDA) normally included in a graphic display apparatus. Therefore, since a microprocessor need only execute processing associated with a display color for each pixel, a load on the microprocessor for the raster operation and the run-length operation can be greatly reduced, and high-speed processing can be achieved.

BRIEF DESCRIPTION OF THE DRAWINGS

Other objects and features of the present invention will be apparent from the following description taken in connection with the accompanying drawings, in which:

FIGS. 4A through 4K are timing charts showing the operation of the embodiment shown in FIG. 3.

DETAILED DESCRIPTION OF THE PREFERRED EMBODIMENTS

Figure 1:
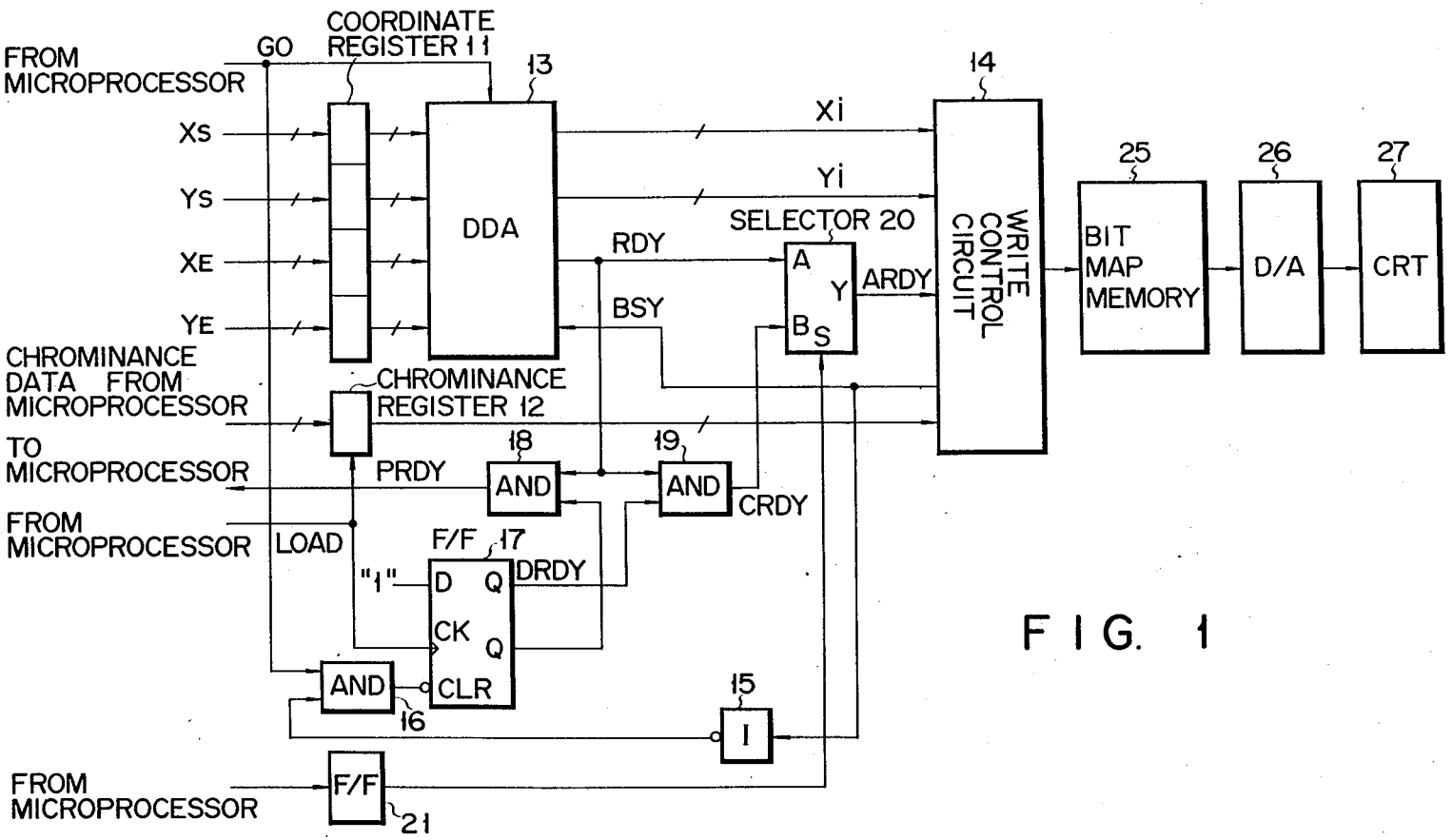
FIG. 1 is a block diagram showing one embodiment of the present invention.

FIG. 1 is a block diagram of a raster operation circuit according to one embodiment of the present invention. The raster operation circuit shown in FIG. 1 is incorporated in a graphic display apparatus. Referring to FIG. 1, coordinate register 11 loads coordinates (Xs, Ys) and (Xe, Ye) of the starting point and the end point, respectively, of a line to be generated. Chrominance register 12 loads chrominance data for specifying a display color for each pixel in response to load signal LOAD from a microprocessor (not shown). Digital differential analyzer (DDA) 13 is activated by start signal GO supplied from the microprocessor, and sequentially generates coordinates (Xi, Yi) of a raster array approximating a line connecting the starting point and the end point from coordinate register 11. Write control circuit 14 controls a write operation to bit map memory 25. More specifically, write control circuit 14 writes the content of chrominance register 12 to a region of memory 25 indicated by coordinates (Xi, Yi) generated from DDA 13 in response to ready signal ARDY. An output signal from bit map memory 25 is converted to an analog signal by D/A converter 26, and is displayed on CRT 27.

Inverter (I) 15 receives busy signal BSY generated by write control circuit 14. An output from I 15 is supplied to one input terminal of AND gate 16, the other input terminal of which receives signal GO. The output signal from AND gate 16 is supplied to a CLR (clear) terminal of flip-flop (F/F) 17. A CK (clock) input terminal of F/F 17 receives load signal LOAD, and a D (data) input terminal thereof normally receives a logic "1" signal. The Q output signal from F/F 17 is supplied to AND gate 18 together with ready signal RDY from DDA 13. The output signal from AND gate 18 is used as ready signal PRDY for requesting, to the microprocessor, a chrominance data load operation to chrominance register 12. The Q output signal from F/F 17 is supplied to AND gate 19 as ready signal DRDY together with ready signal RDY.

The output signal from AND gate 19 is supplied to a B input of selector 20 as ready signal CRDY. An A input of selector 20 receives ready signal RDY from DDA 13, and an S (selection control) input thereof receives an output signal from flip-flop (F/F) 21 for switching between the line processing and raster operation modes as a selection control signal.

The output signal from selector 20 is supplied to write control circuit 14 as ready signal ARDY.

Figure 2:
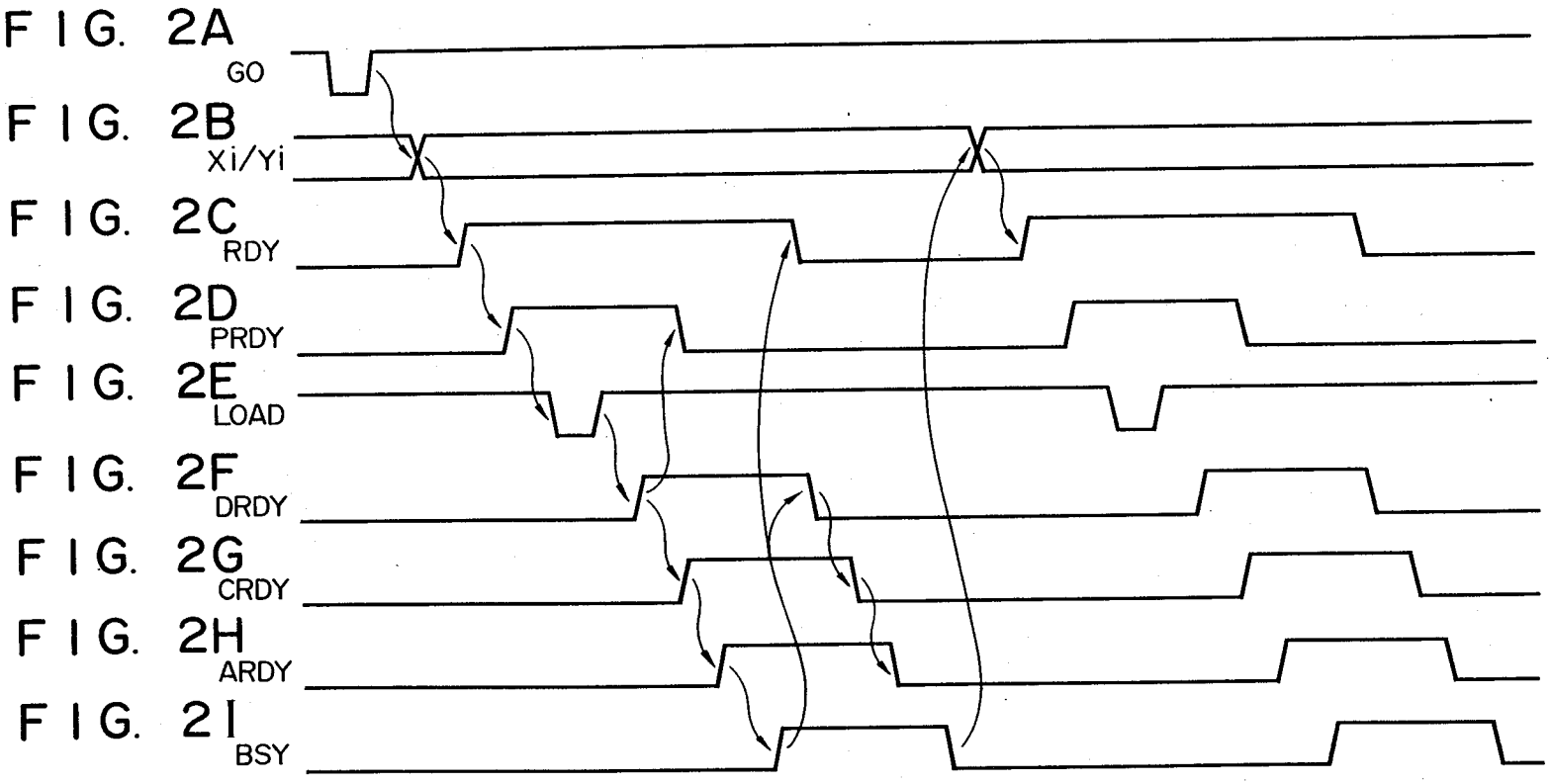
FIGS. 2A through 2I are timing charts showing the operation of the embodiment shown in FIG. 1.

The operation of the circuit shown in FIG. 1 will be described with reference to timing charts shown in FIGS. 2A through 2I. When a rater operation is performed using the circuit shown in FIG. 1, the microprocessor first sets F/F 21. As a result, the circuit in FIG. 1 is set in the raster operation mode. Next, the microprocessor sets coordinates (Xs, Ys) and (Xe, Ye) of the starting and end points of a scan line in coordinate register 11, and generates active (LOW-level) start signal GO, as shown in FIG. 2A. Start signal GO is supplied to DDA 13, and to one input terminal of AND gate 16. The other input terminal of AND gate 16 receives busy signal BSY shown in FIG. 2I which is supplied from write control circuit 14 and is inverted via I 15. As a result, AND gate 16 receives HIGH-level busy signal BSY and active (LOW-level) start signal GO. Thereby, the output signal from AND gate 16 goes to LOW level. In response to the LOW-level output signal from AND gate 16, F/F 17 is reset. More specifically, F/F 17 is reset by active start signal GO. When DDA 13 is activated by signal GO from the microprocessor, it produces coordinates (Xs, Ys) of the starting point as coordinates (Xi, Yi) to write control circuit 14, and sets ready signal RDY at HIGH level, as shown in FIG. 2C, to indicate the completion of coordinate setting. AND gate 18 is turned on when ready signal RDY from DDA 13 goes to HIGH level while F/F 17 is reset. Then, ready signal PRDY as the output signal from AND gate 18 goes to HIGH level, as shown in FIG. 2D. Ready signal PRDY from AND gate 18 is supplied to the microprocessor.

The microprocessor checks ready signal PRDY. When signal PRDY goes to HIGH level, the microprocessor sets chrominance data corresponding to the coordinates (in this case, those of the starting point) generated from DDA 13 in chrominance register 12 in response to load signal LOAD shown in FIG. 2E. Load signal LOAD is also supplied to the CK input terminal of F/F 17. As a result, F/F 17 is set, and ready signal DRDY as the Q output signal therefrom goes to HIGH level, as shown in FIG. 2F. Ready signal CRDY as the output signal from AND gate 19 goes to HIGH level, as shown in FIG. 2G, after HIGH-level ready signal RDY from DDA 13. Ready signal PRDY as the output signal from AND gate 18 goes to LOW level regardless of ready signal RDY from DDA 13, since the Q output signal from F/F 17 goes to LOW level.

Selector 20 receives the HIGH level signal from F/F 21 at its S input terminal, and also receives ready signal RDY from DDA 13 at its A input terminal and ready signal CRDY from AND gate 19 at its B input terminal, respectively, thus selecting ready signal CRDY. The output signal from selector 20 is supplied to write control circuit 14 as ready signal ARDY, as shown in FIG. 2H.

When ready signal ARDY from selector 20 goes to HIGH level, write control circuit 14 detects the completion of coordinate setting of DDA 13, and starts a write operation for writing chrominance data set in chrominance register 12 in the region of bit map memory 25 specified by coordinates (Xi, Yi) (in this case, those of the starting point) generated from DDA 13. At the same time, circuit 14 sets busy signal BSY at HIGH level to indicate that the write operation is busy, as shown in FIG. 2I.

When busy signal BSY from circuit 14 is at HIGH level, AND gate 16 is turned off and F/F 17 is reset. At the same time, DDA 13 sets ready signal RDY at LOW level, and calculates coordinates of the next approximate point during the HIGH-level interval of signal BSY, i.e., during the write operation of write control circuit 14.

When write control circuit 14 completes a single write operation of chrominance data in memory 25, it sets busy signal BSY to LOW level. In response to LOW-level busy signal BSY, DDA 13 generates the next coordinates (Xi, Yi) calculated during the HIGH-level interval of signal BSY, and sets ready signal RDY at HIGH level. As a result, the circuit shown in FIG. 1 returns to an initial state wherein DDA 13 starts an operation in response to start signal GO from the microprocessor. When the above operation is repeated, display color specification in units of pixels is performed along a single scan line. After the microprocessor sets the coordinates of the starting and end points of the single scan line in coordinate register 11 and generates start signal GO, it can simply set chrominance data corresponding to the coordinates from DDA 13 in chrominance register 12 in response to HIGH-level ready signal PRDY. Each time the microprocessor completes display color specification in units of pixels for a single scan line, it sets the next coordinates of the starting and end points of the next scan line and generates start signal GO. The above operation is repeated for each scan line, thus completing the raster operation.

Next, a case will be described wherein the circuit shown in FIG. 1 is used in the normal line processing mode. In this case, the microprocessor sets F/F 21, and sets the circuit shown in FIG. 1 in the line processing mode. In the line processing mode in which F/F 21 is in the reset state, selector 20 selects ready signal RDY from ready signal RDY from DDA 13 and ready signal CRDY from AND gate 19, and supplies it to write control circuit 14. Therefore, write control circuit 14 performs the write operation in memory 25 when coordinates (Xi, Yi) are generated from DDA 13 and ready signal RDY goes to HIGH level.

Figure 3:
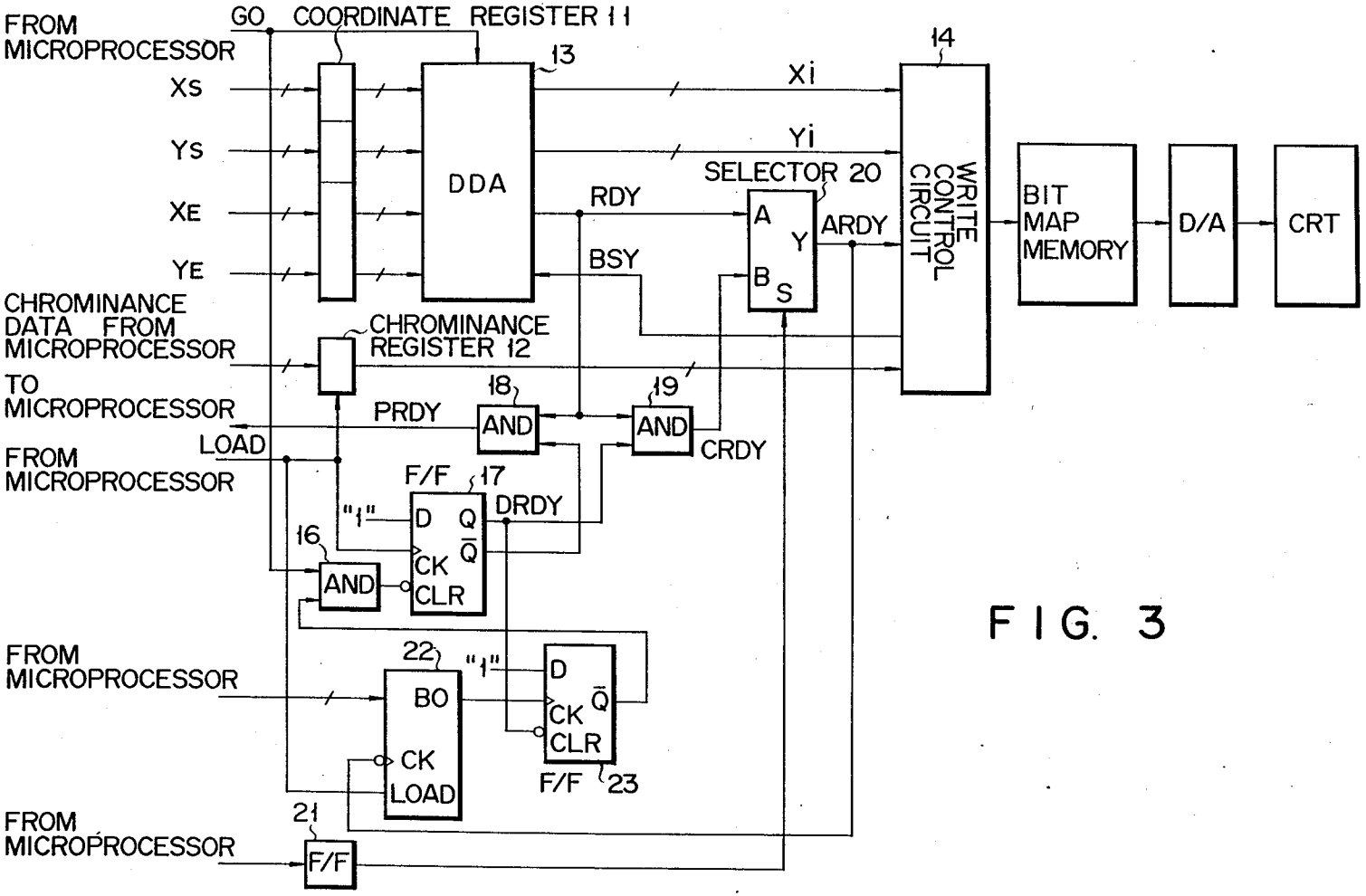
FIG. 3 is a block diagram showing another embodiment of the present invention.

Another embodiment of the present invention will now be described with reference to FIGS. 3 through 4K. A difference between the embodiments shown in FIGS. 1 and 3 is that in FIG. 3 down counter 22 and D flip-flop (F/F) 23 are added to the circuit shown in FIG. 1. Down counter 22 receives ready signal ARDY at its clock input and load signal LOAD at its load input. The CK (clock) input of F/F 23 receives a BO (borrow) signal from counter 22, a CLR (clear) input receives ready signal DRDY (to be described later), and a D input normally receives a logic "1" signal.

The operation of the circuit shown in FIG. 3 will be described with reference to the timing charts shown in FIGS. 4A through 4K. When a run-length operation is performed using the circuit shown in FIG. 3, the microprocessor first sets F/F 21. As a result, the circuit shown in FIG. 3 is set in the run-length operation mode. Next, the microprocessor sets coordinates (Xs, Ys) and (Xe, Ye) of the starting point and the end point, respectively, of a single scan line in coordinate register 11, and generates active (LOW-level) start signal GO, as shown in FIG. 4A. Start signal GO is supplied to DDA 13, which then starts operation. LOW-level start signal GO from the microprocessor is also supplied to the CLR input terminal of F/F 17, thereby resetting F/F 17.

When DDA 13 is activated by start signal GO from the microprocessor, it supplies coordinates (Xs, Ys) of the starting point to write control circuit 14 as coordinates (Xi, Yi), and sets ready signal RDY at HIGH level, as shown in FIG. 4C, to indicate the completion of coordinate setting. AND gate 18 is turned on when ready signal RDY from DDA 13 goes to HIGH level while F/F 17 is reset. Thereby, ready signal PRDY as the output signal from AND gate 18 goes to HIGH level, as shown in FIG. 4D. Ready signal PRDY from AND gate 18 is supplied from the microprocessor.

The microprocessor checks ready signal PRDY. When signal PRDY goes to HIGH level, the microprocessor sets in counter 21 the number of pixels (in this case, the actual number of pixels −1; in FIG. 4F, 2) to be displayed in identical color using the coordinates (in this case, those of the starting point) generated from DDA 13 as the starting coordinates, in response to load signal LOAD. This is called initialization of counter 22. However, the number of pixels as an initial value need not be a fixed value. At the same time, the microprocessor sets chrominance data in chrominance register 12 in response to load signal LOAD.

Load signal LOAD from the microprocessor is also supplied to the CK input of F/F 17. As a result, F/F 17 is set, and ready signal DRDY as the Q output therefrom goes to HIGH level, as shown in FIG. 4H. Ready signal CRDY as the output signal from AND gate 19 goes to HIGH level after HIGH-level ready signal RDY from DDA 13. Ready signal PRDY as the output signal from AND gate 18 goes to LOW level regardless of ready signal RDY from DDA 13 since the Q output signal from F/F 17 goes to LOW level.

When F/F 21 is set as in this embodiment (i.e., in the run-length operation mode), since the S input of selector 20 is set at HIGH level, selector 20 selects ready signal CRDY from ready signal RDY from DDA 13 supplied to its A input and ready signal CRDY from AND gate 19 supplied to its B input. The output signal from selector 20 is supplied to write control circuit 14 and the CK input of counter 22 as ready signal ARDY (FIG. 4J).

When ready signal ARDY from selector 20 goes to HIGH level, write control circuit 14 detects the completion of the coordinate setting operation of DDA 13, and starts the write operation for writing chrominance data set in chrominance register 12 in the region of the bit map memory indicated by coordinates (Xi, Yi) (in this case, those of the starting point) from DDA 13. At the same time, circuit 14 sets busy signal BSY at HIGH level (active), as shown in FIG. 4K, to indicate that the write operation is busy, and supplies it to DDA 13.

When busy signal BSY from write control circuit 14 goes to HIGH level, DDA 13 sets ready signal RDY at LOW level, and calculates the coordinates of the next approximate point during the HIGH-level interval of busy signal BSY, i.e., during the write operation of circuit 14. When ready signal RDY from DDA 13 goes to LOW level, AND gate 19 is turned off, and ready signal CRDY as the output signal from AND gate 19, i.e., ready signal ARDY as the output signal from selector 20, goes to LOW level.

When write control circuit 14 completes a single write operation for the chrominance data in the bit map memory, it sets busy signal BSY at LOW level. In response to this, DDA 13 produces coordinates (Xi, Yi) of the next point calculated during the HIGH-level interval of signal BSY to write control circuit 14, and sets ready signal RDY at HIGH level. When ready signal RDY from DDA 13 goes to HIGH level again, since F/F 17 is in the set state, i.e., since ready signal DRDY is kept at HIGH level, AND gate 19 is turned on again. Then, ready signal CRDY goes to HIGH level and, therefore, ready signal ARDY also goes to HIGH level. In response to this, write control circuit 14 restarts the write operation for the next point.

Counter 22 performs a count-down operation each time ready signal ARDY from selector 20 goes to LOW level. When count CN of counter 22 has reached "0", as shown in FIG. 4F, counter 22 generates an active (LOW-level) BO signal, as shown in FIG. 4G. When the BO signal is generated from counter 22, F/F 23 is set in response to the leading edge of the BO signal. AND gate 16 is then turned off, thereby resetting F/F 17. Ready signal DRDY as the Q output signal from F/F 17 thus goes to LOW level, as shown in FIG. 4H.

When F/F 17 is reset and ready signal DRDY goes to LOW level, AND gate 19 will not be turned on even if ready signal RDY goes to HIGH level thereafter. In this case, ready signal CRDY, i.e., ready signal ARDY, does not go to HIGH level, and the write operation of write control circuit 14 is inhibited. In contrast to this, when F/F 17 is reset as described above, AND gate 18 is turned on when ready signal RDY from DDA 13 goes to HIGH level thereafter. When AND gate 18 is enabled, ready signal PRDY as the output signal therefrom goes to HIGH level.

When ready signal PRDY goes to HIGH level, the microprocessor sets next chrominance data in chrominance register 12 and the number of continuous pixels (n−1 in FIG. 4F), the color of which is specified by the chrominance data, in counter 22 in response to load signal LOAD. At this time, F/F 17 is set by load signal LOAD, and ready signal DRDY again goes to HIGH level. In response to this, ready signal CRDY, i.e., ready signal ARDY, goes to HIGH level in accordance with HIGH-level ready signal RDY from DDA 13. Thus, write control circuit 14 restarts write access of new chrominance data.

When the above operation is repeated, display color specification for an arbitrary number of continuous pixels is performed along a single scan line. After the microprocessor sets the coordinates of the starting and end points of the single scan line in coordinate register 11 and generates start signal GO, it need only set chrominance data and the number of continuous pixels in register 12 and counter 22, respectively, each time ready signal PRDY goes to HIGH level. Thus, the microprocessor sets the coordinates of the starting and end points of the next scan line in coordinate register 11 and generates start signal GO each time display color specification for the scan line is completed. The above operation for the scan lines is repetitively performed, thus completing the run-length operation.

In the embodiment shown in FIG. 3, counter 22 is a down counter, but can be an up counter. In this case, for example, (maximum count−number of pixels) is set in the up counter, and a carry signal can be supplied to the CK input of F/F 23. Alternatively, if a pixel number setting register and a comparator are added, the comparator can detect a coincidence between the count of the up counter and the content of the pixel number setting register, and a detection signal therefrom can be supplied to the CK input of F/F 23.

What is claimed is:

1. A raster operation circuit in a graphic display apparatus, which is activated by a start signal from a microprocessor and comprises a digital differential analyzer for sequentially generating coordinates of a raster array approximating a line connecting a given starting point and an end point and a bit map memory for storing pixel data, comprising:

a register for loading chrominance data in response to a load signal from said microprocessor;

a write control circuit for writing the content of said register in a region of said bit map memory specified by coordinates generated from said digital differential analyzer in response to a first ready signal and generating a busy signal indicating that said write control circuit is busy;

a first flip-flop which is reset in response to the busy signal from said write control circuit and is set in accordance with the load signal;

a first gate for producing a third ready signal (PRDY) requesting to said microprocessor a chrominance data load operation with respect to said register in response to a second ready signal (RDY) indicating completion of a coordinate setting operation from said digital differential analyzer when said first flip-flop is in a reset state;

a second gate for generating a fourth ready signal (CRDY) in response to the second ready signal when said first flip-flop is in a set state;

a second flip-flop for setting one of a line processing mode and a raster operation mode in response to a mode signal from said microprocessor; and a selector for selecting one of said second and fourth ready signals in accordance with the logic state of said second flip-flop and supplying the selected ready signal as the first ready signal to said write control circuit.

2. A circuit according to claim 1, wherein said first flip-flop is also reset by the start signal.

3. A circuit according to claim 2, wherein the starting point and the end point are those of a scan line.

4. A run-length operation circuit in a graphic display apparatus, which is activated by a start signal from a microprocessor and comprises a digital differential analyzer for sequentially generating coordinates of a raster array approximating a line connecting a given starting point and an end point and a bit map memory for storing pixel data, comprising:

a register for loading chrominance data in response to a load signal from said microprocessor;

a write control circuit for writing the content of said register in a region of said bit map memory specified by coordinates generated from said digital differential analyzer in response to a first ready signal (ARDY) and generating a busy signal indicating that said write control circuit is busy;

a counter, initialized by the load signal, for performing a count operation in response to the first ready signal;

a first flip-flop which is reset when said counter counts the number of continuous pixels to be displayed in an identical color specified by said microprocessor, and is set in accordance with the load signal;

a first gate for producing a third ready signal (PRDY) requesting to said microprocessor a chrominance data load operation and a pixel number specification operation with respect to said register in response to a second ready signal (RDY) indicating completion of a coordinate setting operation from said digital differential analyzer when said first flip-flop is set in a reset state;

a second gate for generating a fourth ready signal (CRDY) in response to the second ready signal when said first flip-flop is in a set state;

a second flip-flop for setting one of a line processing mode and a run-length operation mode in response to a mode signal from said microprocessor; and a selector for selecting one of said second and fourth ready signals in accordance with the logic state of said second flip-flop and supplying the selected ready signal as the first ready signal to said write control circuit.

5. A circuit according to claim 4, wherein said first flip-flop is also reset by the start signal.

6. A circuit according to claim 5, wherein the starting point and the end point are those of a scan line.

* * * * *